US005904085A

United States Patent [19]

Onishi et al.

[11] Patent Number: 5,904,085

[45] Date of Patent: May 18, 1999

[54] SHEET MATERIAL CUTTING APPARATUS

[75] Inventors: Takamasa Onishi; Zentaro Kamura, both of Gumma, Japan

[73] Assignee: Onishilite Industry Co., Ltd., Gumma, Japan

[21] Appl. No.: 08/786,315

[22] Filed: Jan. 22, 1997

[30] Foreign Application Priority Data

Jan. 24, 1996 [JP] Japan ..... 8-9714

[51] Int. Cl.[6] ..... B26D 1/18; B26D 1/20

[52] U.S. Cl. ..... 83/479; 83/488; 83/614; 83/698.41; 83/564; 83/578

[58] Field of Search ..... 83/479, 482, 485, 83/487, 488, 489, 553, 508, 564, 578, 556, 614, 423, 508.1, 698.41, 437.1, 676, 675, 677, 472, 508.2, 627, 471.1, 519, 563, 455

[56] References Cited

U.S. PATENT DOCUMENTS

| | | | |
|---|---|---|---|
| 1,996,224 | 4/1935 | Wedekind | 83/578 |
| 2,776,710 | 1/1957 | Homery et al. | 83/482 X |
| 3,561,312 | 2/1971 | Jones | 83/485 |
| 3,686,991 | 8/1972 | Fujimoto | 83/482 |
| 4,046,044 | 9/1977 | Paterson et al. | 83/489 |
| 4,414,874 | 11/1983 | Barnes et al. | 83/488 |
| 4,665,787 | 5/1987 | Arnold et al. | 83/485 |
| 5,042,349 | 8/1991 | Komatsu | 83/485 X |
| 5,307,716 | 5/1994 | Onishi et al. | 83/488 |
| 5,503,053 | 4/1996 | Onishi et al. | 83/488 |

FOREIGN PATENT DOCUMENTS

| | | | |
|---|---|---|---|
| 373244 | 4/1923 | Germany | 83/485 |
| 934951 | 8/1963 | United Kingdom | 83/485 |

*Primary Examiner*—Rinaldi I. Rada
*Assistant Examiner*—Boyer Ashley
*Attorney, Agent, or Firm*—Foley & Lardner

[57] ABSTRACT

An improved sheet material cutting apparatus having a construction in which a rotary blade and a fixed blade are mounted on the housing of a supporting member. The rotary blade inclining forward only during cutting of the sheet material, and the rotary blade being lifted up from the fixed blade during travel when not cutting the sheet material. The sheet material cutting apparatus is provided with a rotation mechanism for rotating the rotary blade. The rotation mechanism, preferably is a roller arranged in a roller housing hole formed in the housing of the supporting member.

14 Claims, 9 Drawing Sheets

SHEET MATERIAL CUTTING APPARATUS

BACKGROUND OF THE INVENTION

The present invention relates to a sheet material cutting apparatus to cut a sheet material by the cooperation of a rotary blade and a fixed blade provided on a supporting member travelling or moving along a frame.

DESCRIPTION OF THE RELATED ART

In a printer for a terminal such as in an ECR or a POS system, a strip-shaped sheet material wound into a roll is pulled out for printing, and then the necessary portion is cut by a cutter into a sheet for delivery.

Various types of such sheet material cutting apparatus are available. A rotary cutter requires high manufacturing costs and causes a relatively high degree of noise and, therefore, is now being replaced by a cutter featuring a combination of a circular rotary cutting blade which moves while rotating and a fixed cutting blade formed into a long sheet.

The prior art sheet material cutting apparatus of this type will be described below with reference to FIGS. 10A and 10B. As shown in FIG. 10A, a supporting member 101 with a rotary blade 102 travels horizontally along a screw shaft 100. As is known from FIG. 10B, the rotary blade 102 is rotatably bearing-supported on a shaft 104 mounted on the supporting member 101 and pressed against a fixed blade 103 by means of a spring 105. In FIG. 10A again, sheet material, fed in the vertical direction to the paper on which said drawing appears, is cut by the rotary and the fixed blades as the supporting members travel horizontally.

With this type of cutting apparatus, it is important, in order to cut the sheet material sharply, that the rotary blade 102 be slightly inclined toward the fixed blade 103 as shown in FIGS. 11 and 12 so that the periphery of the rotary blade 102 comes into contact with the edge of the stationary blade at a certain point in the direction of travel of the rotary blade 102. Particularly, when one wishes to cut a sheet material by both the forward and backward travel of the rotary blade 102, means to switch the inclination of the rotary blade between the forward and backward travel is necessary. This type of apparatus is actually proposed in, for example, Japanese Examined Patent Publication No. 50-24,466/1975. A drawback of this apparatus is that switching the rotary blade is complex and expensive because the rotary blade is switched for necessary inclination by using additional components such as a wire stretched horizontally or a lever oscillating around a pivot shaft.

To solve the above problems of the conventional apparatus, the inventors of the present invention have already proposed a sheet material cutting device as disclosed in Japanese Unexamined Patent Publication No. 05-200,694 and U.S. Pat. No. 5,307,716; both of which are hereby incorporated in there entirety by reference. This device is provided with a rotary blade mounted on a supporting member and a roller provided in a roller housing hole provided on the housing of the supporting member to rotate this rotary blade, the roller being arranged to come into contact with the rear surface of the rotary blade and the rail surface of the frame in the housing hole, and this device permits satisfactory cutting of a strip-shaped sheet material such as paper by transferring the rotation force of the roller which is generated by the travel of the supporting member and causing the rotary blade to incline by the angle necessary for cutting. Because, however, the fixed blade cooperating with the rotary blade in the foregoing device must be mounted on the frame side over the range of travel of the supporting member various operational difficulties result.

SUMMARY OF THE INVENTION

One of the objectives of the invention is to identify and solve the operational difficulties of the inventor's sheet cutting material device that cured the problems of the conventional device, discussed above. The inventor's of this invention have discovered that because the fixed blade cooperating with the rotary blade in their foregoing device must be mounted on the frame side over the range of travel of the supporting member, the following problems with the device have been identified:

A. A long fixed blade is necessary;

B. With a long fixed blade, it is necessary to provide a fixed blade having a prescribed thickness and strength to prevent deformation of the fixed blade;

C. The fixed and the rotary blades must be kept in constant contact with each other to ensure sharp cutting, and for this purpose, it is necessary to improve the tooling precision of the fixed blade over the entire length thereof, i.e., improved working precision of the fixed blade is indispensable;

D. Ensuring high tooling precision of the fixed blade over the entire length thereof results in a higher working cost of the tool edge of the fixed blade;

E. The long and thick fixed blade leads to a larger weight; and

F. Depending upon the status of contact between the rotary and the fixed blades, wear of the tool edge of the fixed blade is not always uniform over the entire blade, and this wear can prevent sharp cutting of a sheet material.

As a result of identifying these problems in their foregoing sheet material cutting apparatus, the present inventors successfully solved these problems by developing a novel sheet material cutting apparatus. This sheet material cutting apparatus of the novel mechanism is characterized by the adoption of a construction in which a rotary blade and a fixed blade are mounted on a supporting member traveling along a frame so as to permit cutting a sheet material by the cooperation of the rotary and the fixed blades. During cutting of the sheet material only a rotary blade that cuts the sheet material, which is positioned in a cutting position, is inclined in a direction of travel of the supporting member. Furthermore, when not cutting the sheet material and when the supporting member is moving in an opposite direction of travel, the rotary cutting blade is lifted up from the fixed blade to a non-cutting position.

In this novel apparatus, in which the fixed blade is mounted on the supporting member, it is not necessary to provide a long fixed blade over the entire length of the frame. It suffices to use a short fixed blade within a range in which the fixed and the rotary blades are in contact with each other, and it is possible to always cut the sheet material sharply since replacement of the fixed blade is easy. Because the rotary blade mounted on the supporting member is inclined forward only during cutting of the sheet material and the rotary blade is lifted up from the fixed blade during in motion when not cutting the sheet material, it is possible to prevent wasteful wear of the rotary or fixed blade, thus improving durability.

As a technical structure to solve the above identified problems, the present invention provides a sheet material cutting apparatus which comprises a supporting member having a housing movably along a frame, at least one cutting blade set provided on the housing of the supporting member, and a positioning device that moves the at least one cutting blade set into a cutting position and a non-cutting position.

The at least one cutting blade set, preferably, includes a fixed blade secured on the housing and a rotary blade supported on the housing. Also, preferable, the positioning device includes a rotation mechanism that moves the rotary blade to the cutting or non-cutting position based on the travel or movement of the supporting member. The rotation mechanism, preferably, is a roller arranged in a roller housing hole formed in the supporting member housing. The roller, preferably, is positioned within the roller housing hole so that the roller contacts both the rotary blade and a rail surface formed on the frame. The roller, which serves as part of the rotation mechanism, inclines the rotary blade in the direction of travel of the support member upon cutting the sheet material.

The apparatus may further comprise a spring member which presses the rotary and fixed blades of the cutting blade set together against each other.

Another structure provided by the present invention is a sheet material cutting apparatus that comprises a supporting member having a housing adapted to move along a frame, a plurality of cutting blade sets provided on the housing of the supporting member. The apparatus is also provided with a positioning device that moves the cutting blade set into a cutting position and a non-cutting position.

Preferably, the plurality of cutting blade set includes two cutting blade set, with each set comprising a rotary blade and a fixed blade. The rotary blade supported on the housing of the supporting member, while the fixed blade is secured on the housing of the support member. The positioning device, preferably, includes a rotation mechanism that rotates the rotary blade of each set into a cutting position as a result of the travel of the supporting member.

The apparatus may further comprise spring members that press the blades of the cutting blade set into engagement with the blades are in a cutting position. That is, the spring member press the rotary and fixed blades of each set together when the rotary blade is in the cutting position.

By reciprocating travel of the supporting member along the frame a sheet material is cut by the sheet material cutting apparatus. Preferably, the sheet material is cut by the cooperation of a first set of the plurality of cutting blades when the supporting member travel in a forward direction, and the sheet material is also cut by the cooperation of a second, or another, set of cutting blades when the supporting member travels backward.

That is, a first set of rotary and fixed blade cut the sheet material during travel of the supporting member in a first direction, while a second set of rotary and fixed blades cut the sheet material during backward travel. The forward, first direction being opposite to the backward, second direction of travel.

BRIEF DESCRIPTION OF THE DRAWINGS

FIG. 1*b* is a side view of FIG. 1*a.

DETAILED DESCRIPTION OF THE PREFERRED EMBODIMENTS

Embodiments of the present invention will now be described with reference to the drawings.

Figure 1A:
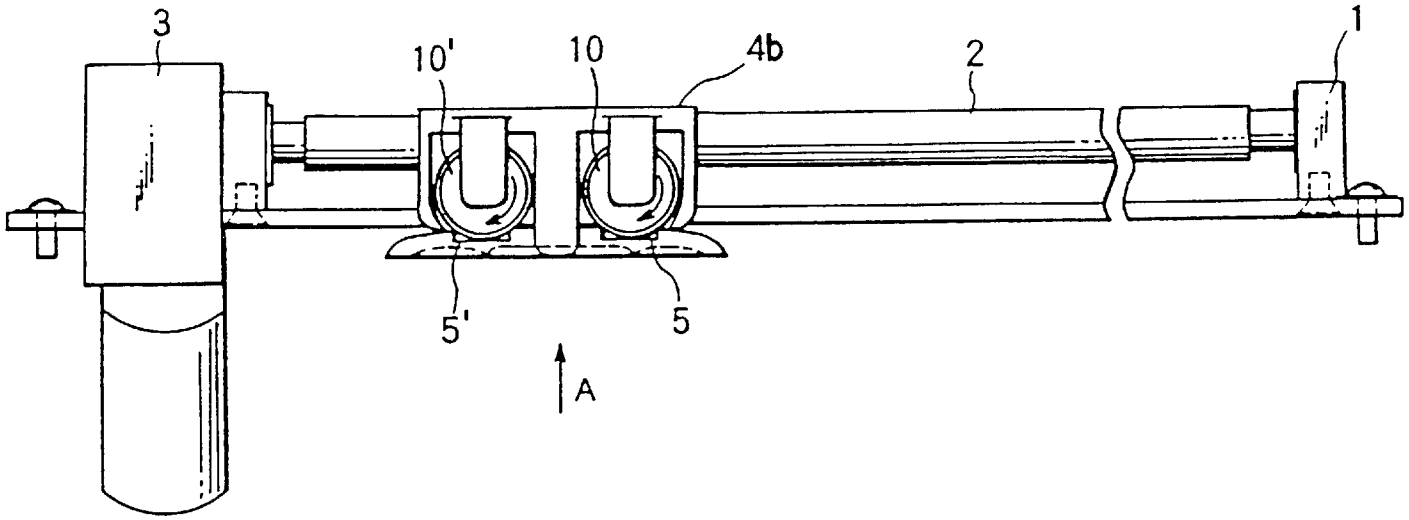
FIG. 1*a* is a plan view of the sheet material cutting apparatus of the present invention.

FIG. 1*a* is a plan view of a sheet material cutting apparatus for both-direction cutting as an embodiment of the present invention. FIG. 1*b* is a side view of FIG. 1*a,* while FIG. 1*c* is a view of FIG. 1*a* as viewed in the direction of the arrow A shown in FIG. 1*a.*

Figure 1C:
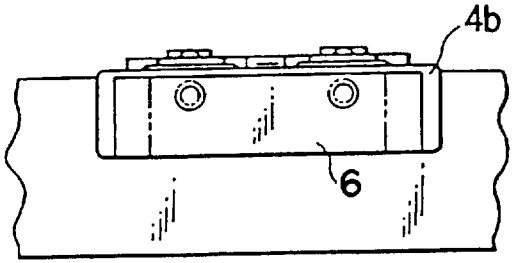
* and FIG. 1*c* is a view of FIG. 1*a* as viewed in the arrow A direction.
Figure 1B:
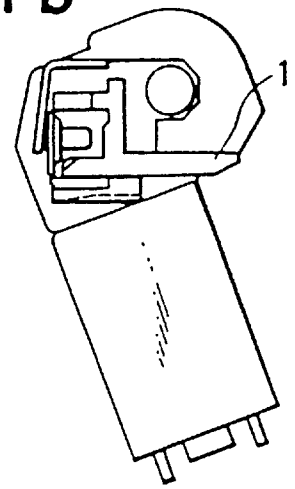

In FIGS. 1*a* to 1*c,* a frame 1 supports both ends of a screw shaft 2. A drive 3 for rotating the screw shaft 2 is attached to an end thereof. The drive 3 comprises a motor and a transmission mechanism for transmitting the rotational force from the motor to the screw shaft 2.

A supporting member 4 for both-direction cutting (with a construction described later) is thread-engaged with the foregoing screw shaft 2. Upon driving the motor 3, the screw shaft 2 rotates, and the supporting member 4 travels or moves horizontally from right to left and from left to right in FIG. 1, depending upon the screw shaft 2.

When the supporting member 4 travels in a forward, first direction, i.e. from a left most original position to the right in FIG. 1, a sheet material 20 is cut by the cooperation of the first set of cutting blades; the first rotary blade 10 and the first fixed blade 5 shown in the right side in FIG. 1. When the supporting member 4 travels in a backward, second direction, i.e., to the left in FIG. 1,. the sheet material 20 is cut by the cooperation of second or another set of cutting blades; the second rotary blade 10' and the second fixed blade 5' shown on the left side in FIG. 1. When the supporting member 4 travels in the second direction, the first set of cutting blades is placed in a non-cutting position, while the second set of cutting blades is moved to a cutting position. Particularly, the first rotary blade 10, since it is not cutting the sheet material 20, is lifted up from the first fixed blade 5 to the non-cutting position, which permits prevention of wasteful wear of the rotary blade 10 and the fixed blade 5.

The reciprocation of the supporting member 4 is accomplished by rotating the screw shaft 2 back and forth by the forward and backward/reverse rotation of the motor or by switching the transmission mechanism. Alternatively, the supporting member 4 can reciprocate along the screw shaft 2, without changing the direction of motor rotation or by switching the transmission, by using continuous right-hand and left-hand threads on the screw shaft 2.

The construction of the supporting member 4 for both-direction cutting as described above will be described below.

Figure 2:
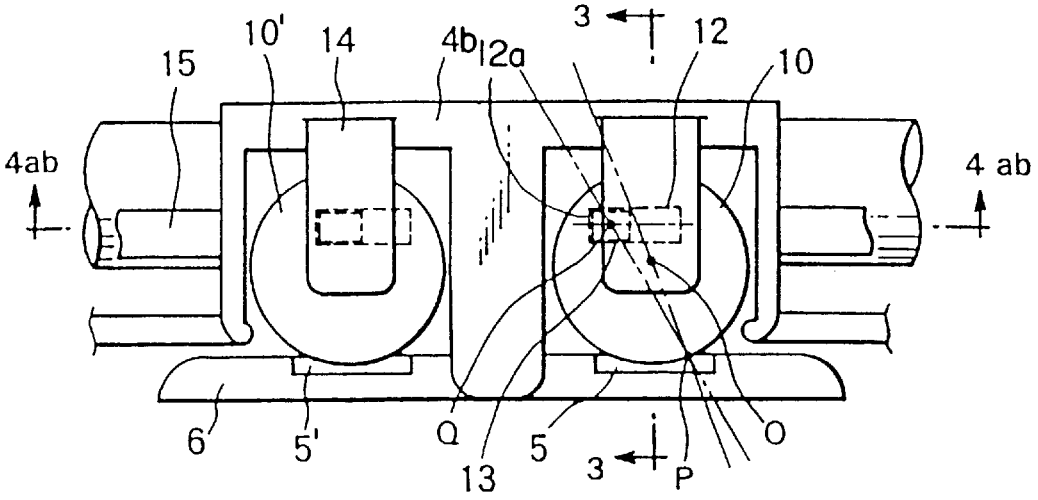
FIG. 2 is a plan view of the supporting member of the present invention.
Figure 3:
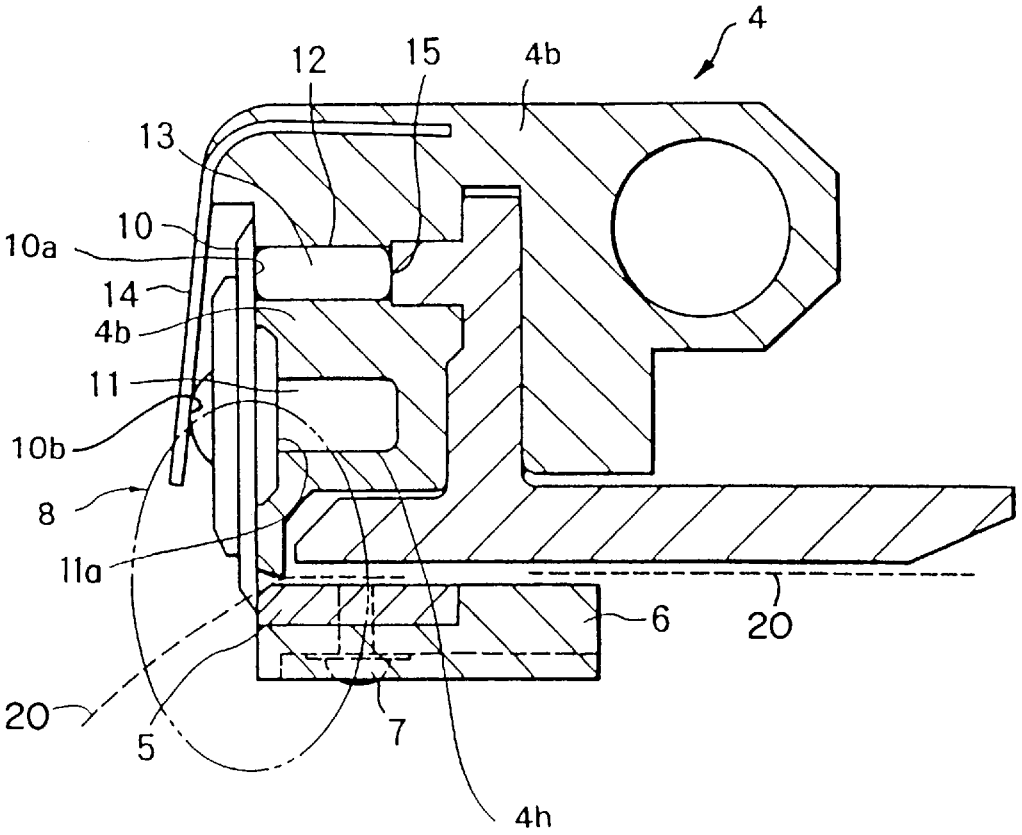
FIG. 3 is a sectional view of FIG. 2 cut along the line 3—3.
Figure 4A:
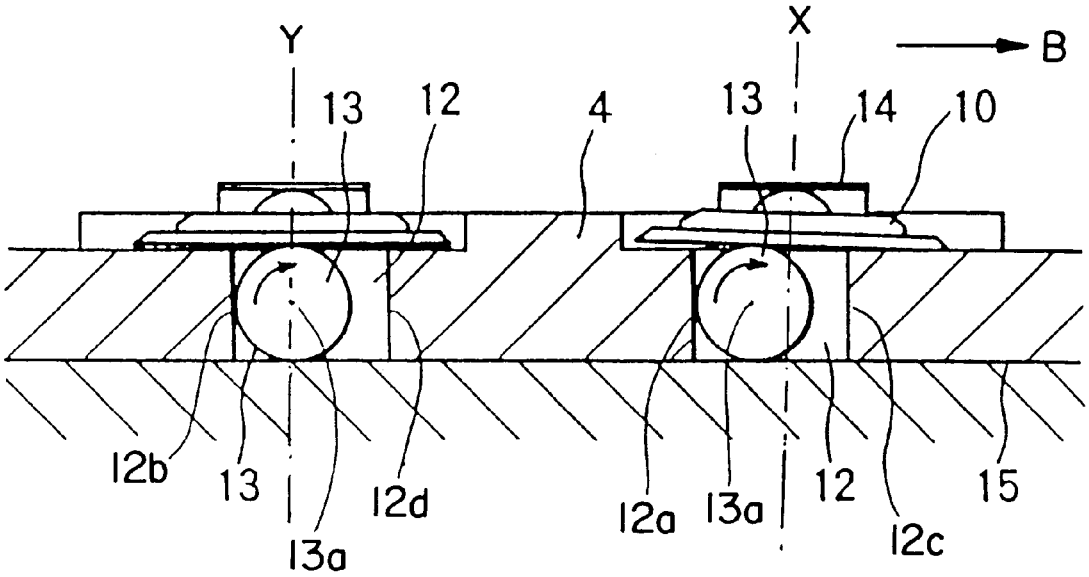
FIGS. 4*a* and 4*b* are sectional views of FIG. 2 cut along the line 4*ab*—4*ab,* and are descriptive views of part of the rotation mechanism; the roller and the roller housing hole.
Figure 4B:
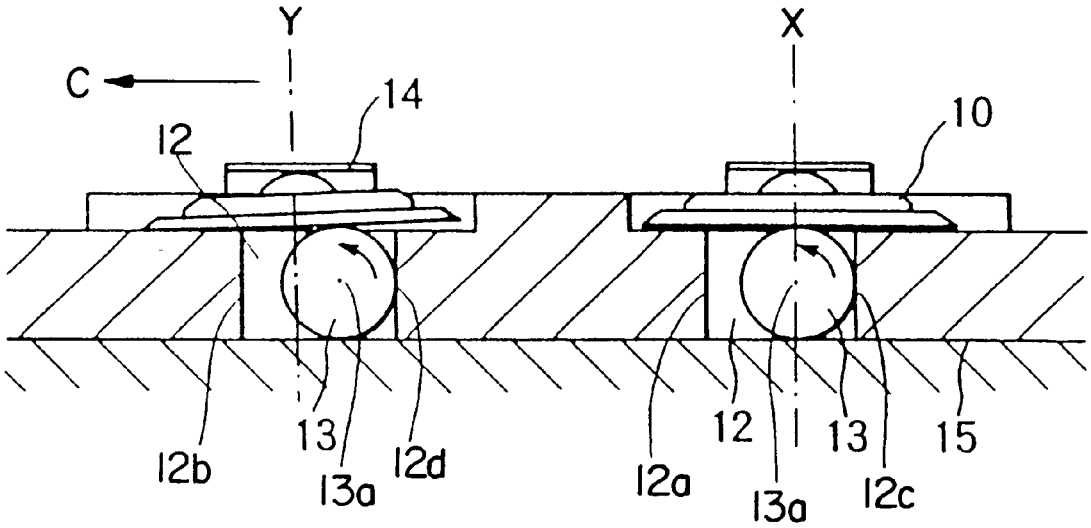

FIG. 2 is a plan view of the supporting member 4, and FIG. 3 is a sectional view of FIG. 2 showing the supporting member 4 along the line 3—3. FIGS. 4*a* and 4*b* are sectional views of FIG. 2 showing the supporting member 4 along the line 4*ab*—4*ab*. FIG. 4*a* illustrates the supporting member 4 travelling or moving to the right, and FIG. 4*b*, the travel or movement of the supporting member 4 to the left.

In FIGS. 2, 3, 4*a* and 4*b*, a fixed blade supporting member 6 is formed integrally with and as part of the supporting member housing 4*b* so that the fixed blade is secured to the a supporting member housing 4*b*. The fixed blade 5 is replaceably secured or fitted to the fixed blade supporting member 6 of support member housing 4*b* by means of a screw 7 or the like. A rotary blade 10, which is attached to one end 11*a* of a shaft 11, is rotatably supported by the shaft 11 onto the supporting member housing 4*b*. The shaft 11 is loosely attached to the supporting member housing 4*b* or loosely inserted into a blade shaft supporting hole 4*h* of the housing 4*b* so as to permit slight inclination of the shaft 11 relative to the supporting member housing 4*b*.

A tension spring 14 serving as a spring member is placed onto the upper center 10*b* of rotary blade 10. The tension spring 14 presses the rotary blade 10 onto the fixed blade 5 allowing the rotary blade 10 to rotate about the shaft 11, which is loosely inserted into the supporting hole 4*h*, when the rotary blade 10 is placed in the cutting position based on the motion of the supporting member 4.

A housing hole 12, having a rectangular shape as shown in FIGS. 4*a* and 4*b*, is formed in the supporting member housing 4*b*. A roller 13 is arranged in this housing hole 12 so as to be capable of reciprocating horizontally in FIG. 2. In FIG. 2, O is the center of the rotary blade.

The housing hole 12 is formed into a long hole running through in parallel with the direction of travel of the supporting member 4. There are two housing holes 12 for each of rollers 13 formed in the supporting member housing 4*b* as shown in FIGS. 2, 4*a* and 4*b*. Either one of the housing holes 12 is formed having a length longer than the diameter of the roller 13 and a depth shorter than the diameter of the roller 13. The vertical shape of the hole can be rectangular as shown in FIGS. 4*a* and 4*b*, and the horizontal shown, in FIG. 2 can be rectangular, oval or any of other similar shapes.

The roller 12, which can be provided without a shaft, is housed in this rectangular hole. The roller can be any shape including a cylindrical or a ball shape. The roller 13 can have a thickness or a diameter slightly smaller than the length of the housing hole 12 and a diameter slightly larger than the depth of the housing hole 12. Further, the roller 13 and the supporting member housing 4*b* may be made of a material such as a rubber or a plastic with excellent slidability to minimize frictional resistance between them The roller 13 can be held between the back surface 10*a* of the rotary blade 10 and a rail surface 15 formed on the frame side by the force imparted by a tension spring 14 serving as a spring member. Therefore, when the supporting member 4 begins traveling to the right in FIG. 2, the roller 13 comes closer to the left end in the housing hole 12 while rotating due to frictional force with the rail surface 15 until it comes into contact with the wall 12*a* which is at one end of the housing hole 12, as shown in FIG. 2. At this point, the rotary blade 10 is supported at two contact points P and Q as shown in FIG. 2. The contact point P is the point where the rotary blade 10 contacts with the fixed blade. The contact point Q is the point where the rotary blade 10 contacts with the roller 13. The rotary blade 10 receives a moment of being pressed against the fixed blade 5 around the supporting axis line PQ which deviates from axis line OP. The shaft 11 of the rotary blade 10 thereby inclines and the rotary blade 10 is pressed at the contact point P against the fixed blade 5 by the roller 13 into a cutting position. By further continuing travel of the supporting member 4 in a first direction, the roller 13 rotates due to frictional force with the rail surface 15, which in turn causes rotation of the rotary blade 10, thus permitting satisfactory cutting of the sheet material 20 located between the rotary and the fixed blades by the cooperation of both blades (see FIG. 3).

At this point, the rotary blade 10' of the set of cutting blades, which is not cutting the sheet material 20 (i.e., the left rotary blade 10' located backward in the direction of travel), is lifted up from the fixed blade into a non-cutting position by the action of the roller 13 having a diameter larger than the depth of the housing hole 12. As a result, wasteful wear of both blades can be prevented because the rotary blade 10' and the fixed blade 5 not cutting the sheet material 20 are not in contact with each other.

When the supporting member 4 returns from a right most position to the left most original position of the screw shaft 2, the screw shaft 2 rotates in the reverse direction to the action of the motor not shown. This rotation causes the supporting member 4 to travel to the left in FIG. 2 in a second direction and the rotary blade 10' of the second set of cutting blades cuts the sheet material 20 in the same manner as described above. In this case, the rotary blade 10' of the second set of cutting blades located backward in the earlier direction of travel (the left side rotary blade 10 shown in FIG. 2 and FIG. 4*a*) is switched over to the rotary blade 10' located forward in the current direction of travel (the left side rotary blade 10' shown in FIG. 2 and FIG. 4*b*). This causes the shaft 11 of the rotary blade 10' to incline forward and rotate in the direction of travel of the supporting member 4 while keeping an appropriate inclination angle to the fixed blade 5', and the other rotary blade 10 (the right side blade 10) is lifted up from the fixed blade 5 as shown in FIG. 4*b*.

Each roller 13 in the foregoing housing hole 12 can be held between the frame and the rotary blade 10 within the housing hole 12, and can be in contact with the frame and the back surface 10*a* of the rotary blade 10. The back surface 10*a* of the rotary blade 10 and the surface of the roller 13 as well as the surface of the rail 15 in contact with the roller 13 on the frame side should therefore preferably be in a state so as to generate an appropriate frictional force.

One side wall of the housing hole 12 is closer to the center axis of the center axis of the rotary blade 10 than the other side wall of the housing hole. The distance between the wall which is closer to the center axis of the rotary blade 10 and the center axis is the same or almost the same as the diameter of roller 13. The relationship between the housing hole 12 and the rollers 13 will be described below more specifically with reference to FIGS. 4*a* and 4*b*.

When the supporting member 4 moves to the right direction (first direction) as shown in FIG. 4*a* with an arrow A, the right roller 13 comes closer to the left side wall 12*a* of the right housing hole 12. Likewise, the left roller 13 comes closer to the left side wall 12*b* of the left housing hole 12. The right housing hole 12 is formed so that, when the right roller 13 contacts the left side wall 12*a*, the center 13*a* of the right roller 13 is located behind the center axis X of the rotary blade 10. On the other hand, the center 13*a* of the left roller 13 is located on the axis Y of the rotary blade when the left roller 13 is at the left side wall 12*b*. The left side wall 12*b* is closer to the center axis Y of the left rotary blade 13 than the left side wall 12*a* to the center axis X of the right rotary blade 13. The center axis X of the right rotary blade 10 is inclined toward the motion direction B of the supporting member 4, and the right rotary blade 10 is pressed onto the fixed blade 5 (not shown) by the spring member 14 thereby the sheet material (not shown) is cut by the right rotary blade 10 and fixed blade 5. The center 13*a* of the left roller 13 is on the center axis Y of the left rotary blade 10' and the left rotary blade 10' is lifted up from the left fixed blade 5' and does not cut the sheet material.

When the supporting member 4 moves to the left (second direction) as shown in FIG. 4*b* with arrow B, on the other hand, the left roller 13 come closer to the right side wall 12*d* within the left housing hole 12. Likewise, the right roller 13 comes closer to the right side wall 12*c* of the right housing hole 12. The left housing hole 12 is formed so that, when the left roller 13 contacts the right side wall 12*d*, the center 13*a* of the left roller 13 is located behind the center axis Y of the rotary blade 10. On the other hand, the center 13*a* of the right roller 13 is located on the axis X of the right rotary blade 10 when the right roller 13 is at the right side wall 12*c*. The right side wall 12*c* is closer to the center axis X of the right rotary blade 13 than the right side wall 12*d* to the center axis Y of the left rotary blade 13. The center axis Y of the left rotary blade 10' is inclined toward the motion direction C of the supporting member 4. On the other hand, the left rotary blade 10' is pressed onto the fixed blade 5' (not shown) by the left spring member 14 thereby the sheet material is cut by the left rotary blade 10' and fixed blade 5. The center 13*a* of the right roller 13 is on the center axis X of the right rotary blade 10 and the right rotary blade 10 is lifted up from the fixed blade 5 and does not cut the sheet material.

Figure 5:
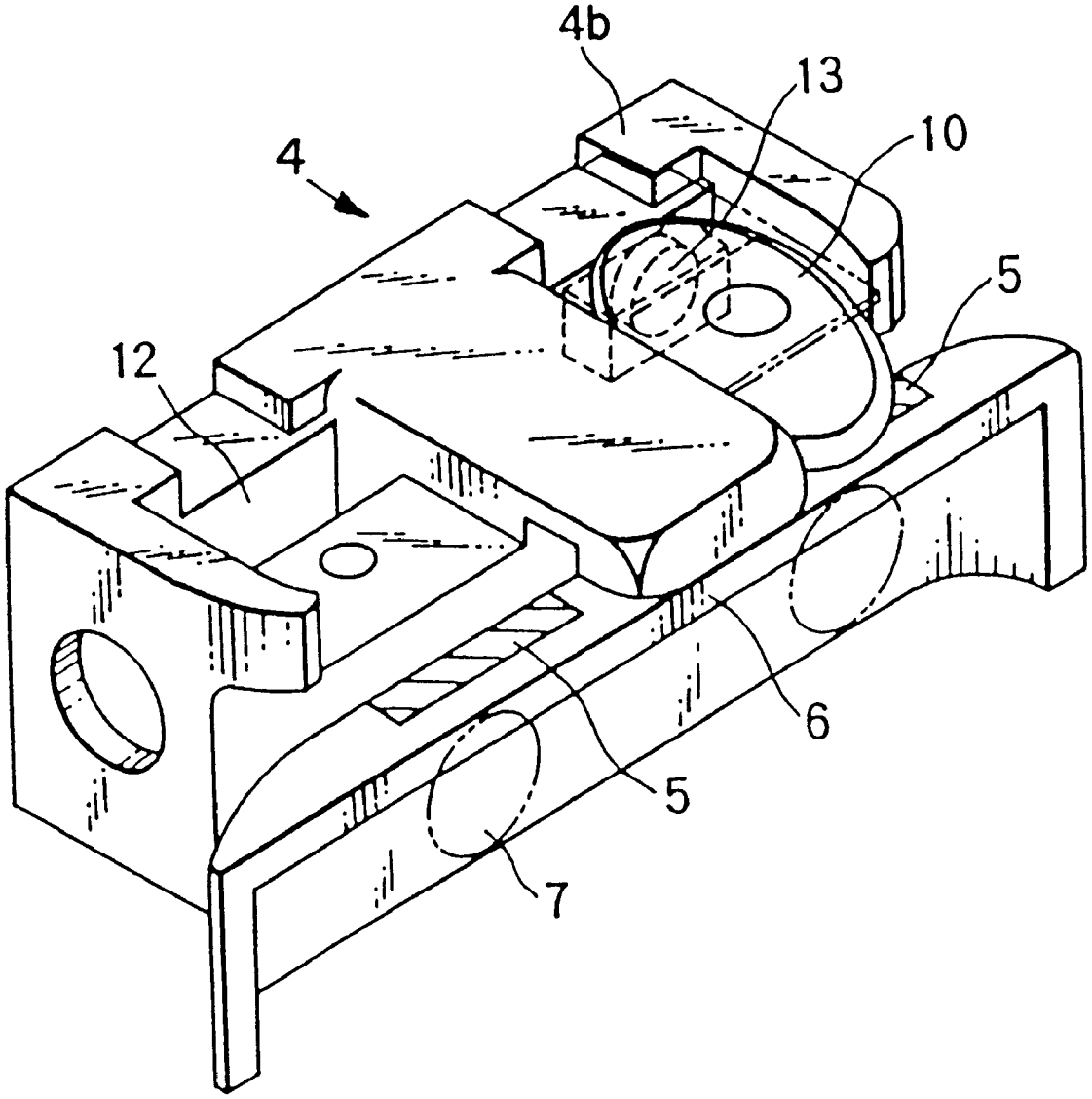
FIG. 5 is a front perspective view of the supporting member for both-directing cutting in which one of the rotary blades is omitted for clarity.
Figure 6:
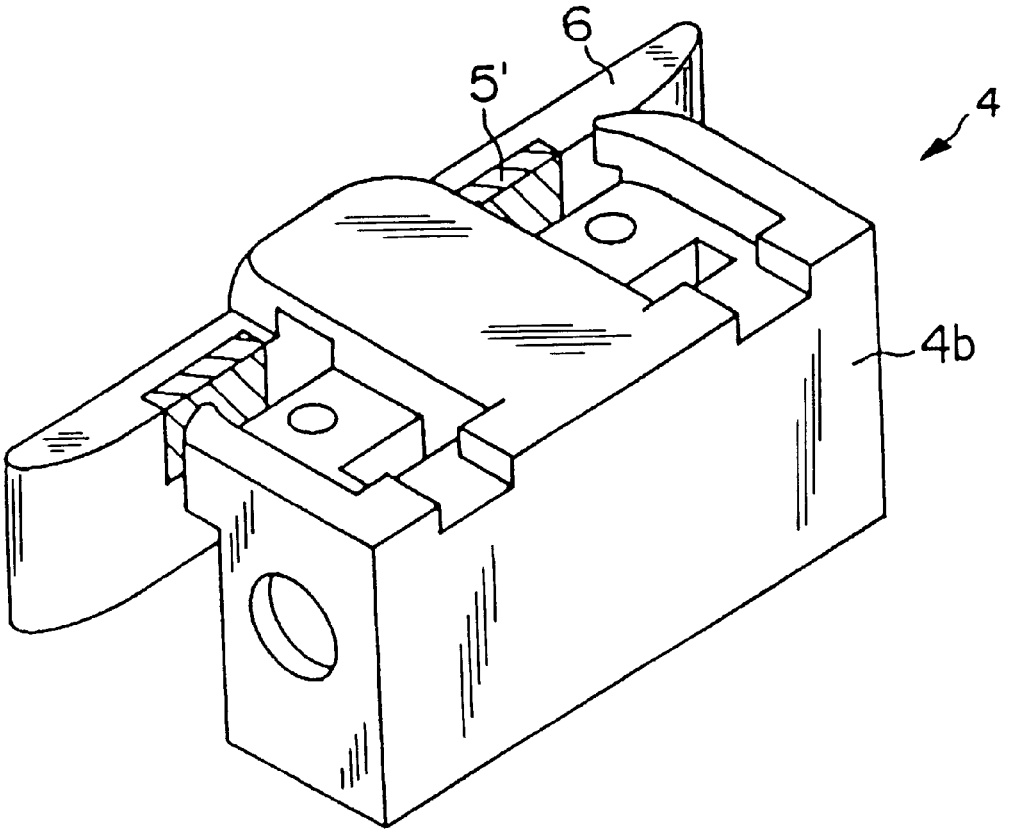
FIG. 6 is a rear perspective view of the supporting member for both-direction cutting as viewed from the back of the supporting member.

FIGS. 5 and 6 are perspective views of the supporting member 4. FIG. 5 is a front perspective view illustrating one of the two rotary blades 10 (the other rotary blade 10' on the supporting member 4 is omitted), and FIG. 6 is a rear perspective view of the supporting member 4. The supporting member 4 is formed integrally with a resin which has excellent slidability. A fixed blade 5 and fixed blade support member 6 are formed with the supporting member housing 4*b*, as described above, and the roller 13 as an inclination member having the function of causing the rotary blade 10 to incline in the direction of travel of the supporting member 4 during cutting a sheet material made incorporation of the fixed blade 5 and the spring member 14.

The fixed blade 5 can be screw-fitted to the supporting member 4 with a screw. 7, and readily replaced when the fixed blade wears out.

The operation of the sheet material cutting apparatus in the above embodiment will be described below.

In FIG. 2, the supporting member 4 is assumed to move to the right along the frame. When the motor not shown is driven, resulting in rotation of the screw shaft 2, and the supporting member 4 begins traveling to the right in FIG. 2, the rollers 13 in the housing hole 12 come closer to the left side wall 12*a* within the housing hole 12 while rotating (see FIG. 4*a*). At this point, the roller 13 in the right side housing hole 12 is located backward in the traveling direction relative to the center axis OP of the rotary blade 10, and only the right rotary blade 10 inclines slightly toward the direction of travel and comes into contact with the fixed blade 5 at a point. When the supporting member 4 continues to travel thereafter, the roller 13 continues to rotate at this position, thus causing the rotary blade 10 to rotate. The sheet material 20 can thus be cut by the cooperation of the set of the rotary blades 10 and the fixed blade 5 on the side of the direction of travel (right side). At this point, the rotary blade 10' on the rear side of the travel direction (left rotary blade 10' shown in FIG. 2) is held in a lifted state from the fixed blade 5' by the roller 13 (see FIG. 4*a*). When the supporting member 4 moves to the left, in contrast, the sheet material 20 can be cut by the rotary blade 10' and the fixed blade 5' on the left side. In this case, only the left rotary blade 10' inclines in the travel direction, comes into contact with the fixed blade at a points and cuts the sheet material 20. The rotary blade 10 located rear side in the travel direction is kept in the lifted state from the fixed blade 5 by the roller 13 and is not in contact with the fixed blade 5.

Figure 7:
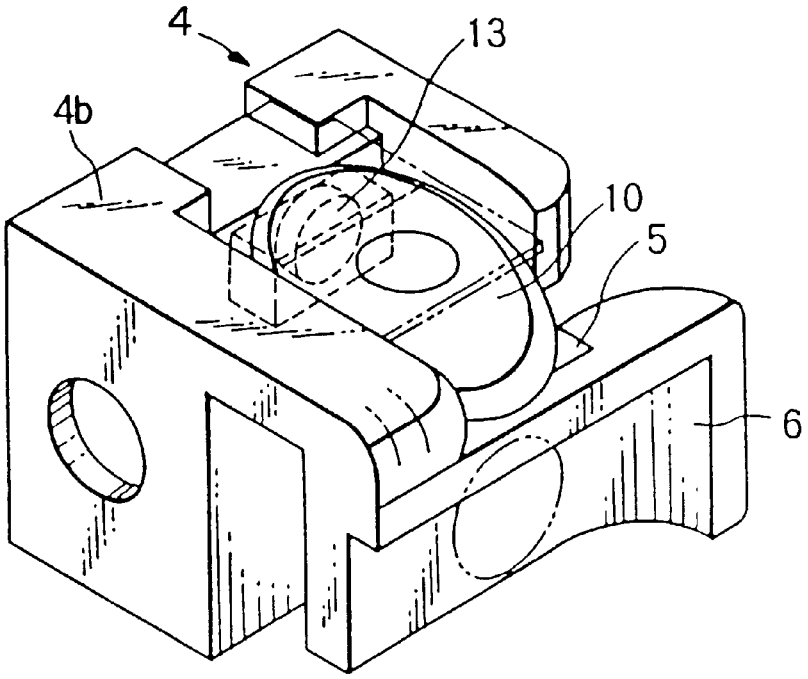
FIG. 7 is a perspective view of the supporting member for single-direction cutting.

The supporting member 4 for single-direction cutting will be described below with reference to FIG. 7. This supporting member 4 can be constructed by dividing the above-mentioned supporting member 4 for both-direction cutting into two, and one of these two divided portions, with the same construction of the rotary blade 10, the fixed blade 5 and the roller 13 as in the supporting member 4 for both-direction cutting can be used for single-direction cutting. By using this supporting member 4 for single-direction cutting, sheet material cutting apparatus for single-direction cutting is provided in which it is possible to cut the sheet material 20 while the rotary blade inclines only during travel of the supporting member 4 in one direction, and keep the rotary blade in the lifted state from the fixed blade during return. Since the foregoing supporting member 4 for single-direction cutting can be replaced by the supporting member 4 for both-direction cutting as required, it is easy to construct a sheet material cutting apparatus for single-side or both-direction cutting.

Another embodiment of the fitting method of the fixed blade 5 will be described below.

Figure 8:
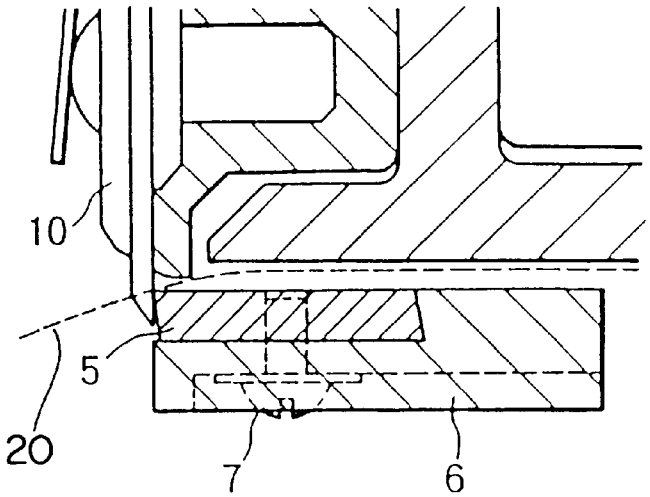
FIG. 8 is a enlarged view of portion 8 shown in FIG. 3.
Figure 9:
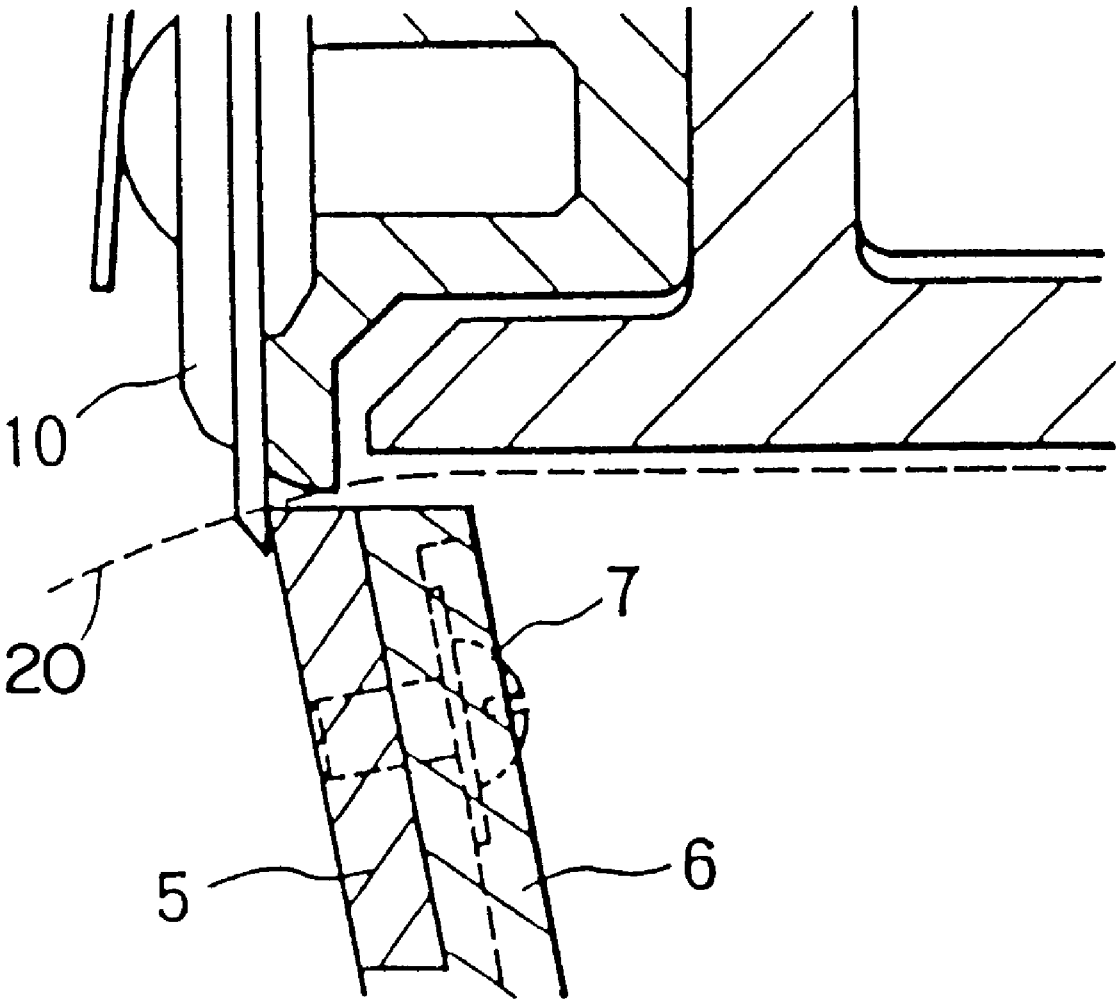
FIG. 9 is a sectional view of fitting of the fixed blade in another embodiment.
Figure 10B:
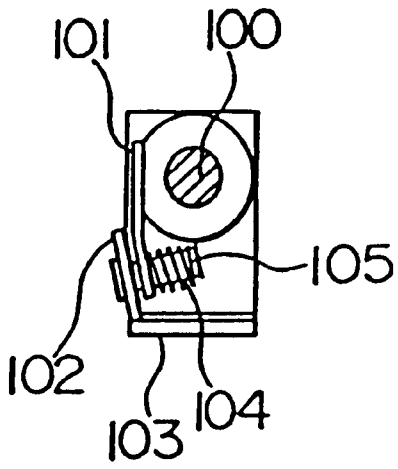
PRIOR ART FIG. 10B
FIGS. 10A and 10B are a schematic construction views of a conventional sheet material cutting apparatus.
Figure 10A:
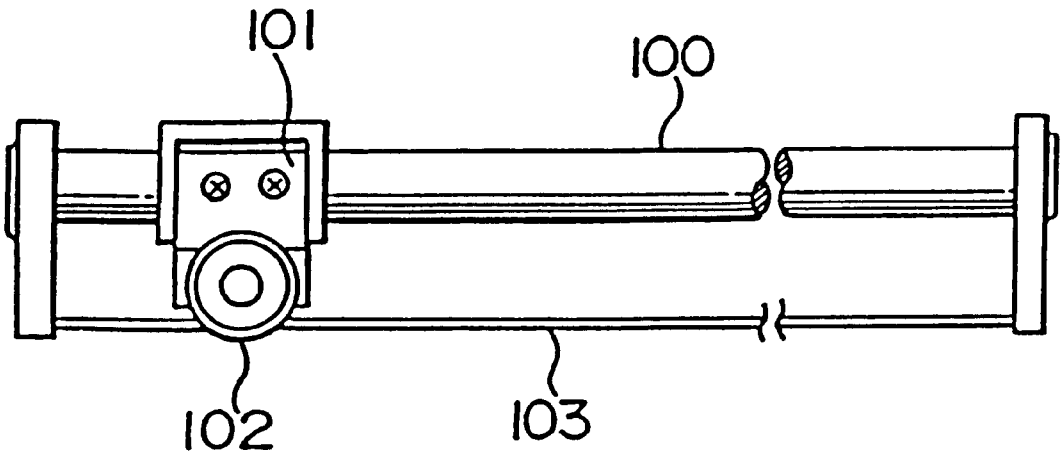
PRIOR ART FIG. 10A
Figure 11:
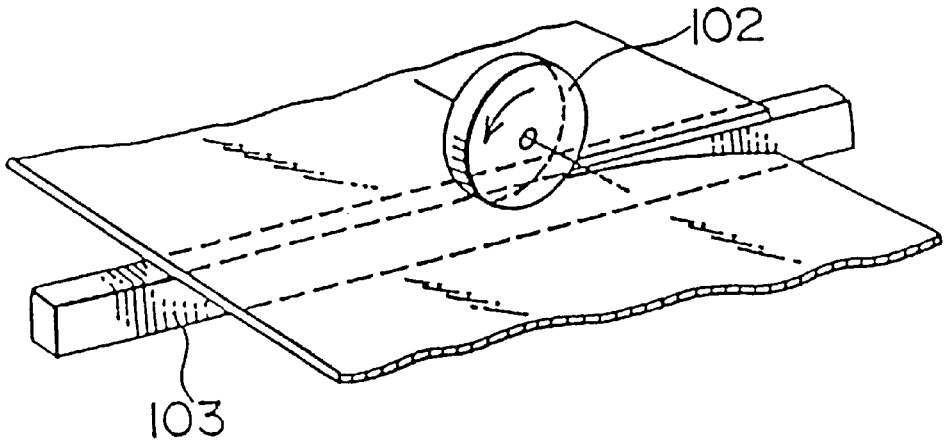
PRIOR ART FIG. 11
FIG. 11 is a descriptive view of operation of the rotary blade of the conventional sheet material cutting apparatus.
Figure 12:
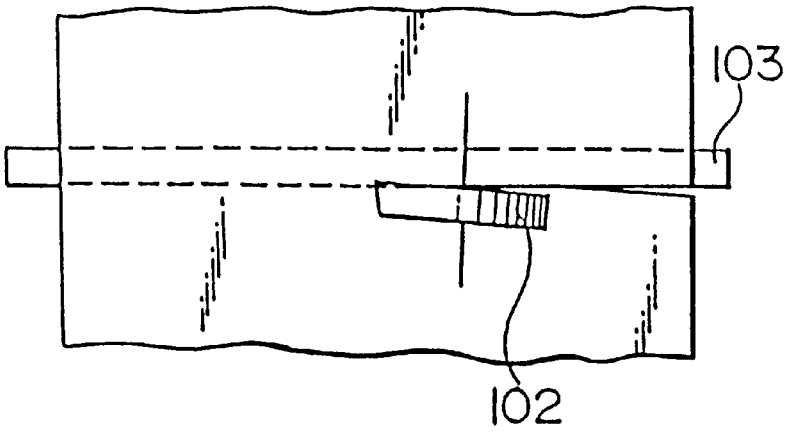
PRIOR ART FIG. 12
FIG. 12 is a plan view illustrating operation of the rotary blade of the conventional sheet material cutting apparatus.

While the fixed blade 5 to be fitted to the supporting member 4 is usually arranged at a right angle to the rotary blade 10 as shown in FIG. 8, it is also possible to fit the fixed blade 5 to the fixed blade stand 6 almost parallel to the rotary blade 10 as shown in FIG. 9. When the fixed blade 5 is fitted to the fixed blade support member or stand 6 as shown in FIG. 9, although the total plane area of the supporting member 4 increases, the rotary blade 10 does not project from the fixed blade 5, so there is no risk that a finger or other part of an operator (not shown) will be injured by the edge of the rotary blade 10. Even for the fixed blade 5 arranged at a right angle to the rotary blade 10, projection of the rotary blade 10 from the fixed blade 5 can be prevented by increasing the thickness of the fixed blade stand 6 to which the fixed blade 5 is to be fitted as shown in FIG. 8.

The sheet material cutting apparatus of the present invention permits, as described above in detail, elimination of the necessity of using a long fixed blade, easier precision control of the fixed blade and reduction of weight of the apparatus, as the rotary blade and the fixed blade are mounted on the supporting member. Because the fixed blade can be easily replaced at any time, the sheet material cutting apparatus always ensures sharp cutting. Easy replacement of the supporting member for both-direction cutting and that for single-direction cutting allows simple construction of any of the sheet material cutting apparatuses for single-direction and both-direction cutting. Furthermore, injury of a finger or any other part of the housing by rotary blade can be avoided by merely changing the thickness or direction of the fixed blade stand. In the sheet material cutting apparatus for, both-direction cutting, only the rotary blade cutting the sheet material inclines in the direction of travel, and the other rotary blade is lifted up from the fixed blade, thus providing many industrially useful effects, including prevention of wasteful wear of the rotary and the fixed blades.

The entire disclosure of Japanese Patent Application No. 8-9714 filed on Jan. 24, 1996, including specification, drawings and claims are herein incorporated by reference in its entirety.

The present invention may be implemented in various other forms of embodiment without deviating from the spirit of the main features thereof. The above-mentioned embodiments are therefore only a few examples and should not be construed as limiting. All variations and alterations falling under the scope of equivalents to the patent claims come under the scope of the present invention.

What is claimed is:

1. A supporting member for a sheet material cutting apparatus, said supporting member comprising:

a housing adapted to move along a frame of the sheet material cutting apparatus, the housing including a first roller housing hole having a first wall opposite a second wall;

a first cutting blade set provided on said housing and including a first fixed blade secured to the housing and a first rotary blade supported on the housing proximate the first fixed blade;

a first spring member that urges the first rotary blade toward the first fixed blade; and a first positioning device including a first rotation mechanism that moves the first rotor blade into a cutting position and a non-cutting position, the first rotation mechanism having a first roller disposed in the first roller housing hole and configured so as to engage both the frame and the first rotary blade, wherein the first roller is movable within the first roller housing hole between a position proximate the first wall and a position proximate the second wall when the housing moves along the frame in a first direction and a second direction, respectively, the first roller housing hole being configured such that, when the first roller is at the position proximate the first wall, the first roller is disposed at a rearward position of the first rotary blade where the first roller moves the first rotary blade into the cutting position and, when the first roller is at the position proximate the second wall, the first roller is disposed at a center position of the first rotary blade where the first roller moves the first rotary blade into the non-cutting position, and wherein the first roller is arranged such that movement of the housing along the frame in the first direction and the second direction will cause rotation of the first roller, which causes rotation of the first rotary blade.

2. The supporting member of claim 1, wherein the first roller inclines said first rotary blade when said first rotary blade is in the cutting position.

3. The supporting member of claim 1, wherein said first roller housing hole is adjacent said first rotary blade and disposed so as to be proximate said frame.

4. The supporting member of claim 1, wherein said first roller is configured so as to be disposed between said first rotary blade and a rail surface of said frame.

5. The supporting member of claim 1, wherein said first fixed blade is removably secured to said housing.

6. The supporting member of claim 1, wherein the first roller moves said first rotary blade into said cutting position by pressing said first rotary blade onto the first fixed blade when the first roller moves into the position proximate said first wall; and wherein said first roller moves said first rotary blade to said non-cutting position by lifting said first rotary blade away from said first fixed blade when the first roller moves into the position proximate said second wall.

7. The supporting member of claim 6, wherein said first fixed blade is removably secured to said housing.

8. The supporting member of claim 1, further comprising a second cutting blade set.

9. The supporting member of claim 8, further comprising a second positioning device that cooperates with said second cutting blade set.

10. The supporting member of claim 9, wherein, when said housing moves in the first direction, said second positioning device moves said second cutting blade set into said non-cutting position, and wherein, when said housing moves in the second direction, said second positioning device moves said second cutting blade set into said cutting position.

11. The supporting member of claim 8, wherein said second cutting blade set comprises a second fixed blade secured to said housing and a second rotary blade supported on said housing proximate said second fixed blade.

12. The supporting member of claim 11, wherein said second positioning device comprises a second rotation mechanism.

13. The supporting member of claim 12, wherein said second rotation mechanism comprises a second roller.

14. The supporting member of claim 13, wherein, when said housing moves in the first direction, said second roller moves said second rotary blade to said non-cutting position by lifting said second rotary blade away from said second fixed blade; and wherein, when said housing moves in the second direction, said second roller moves said second rotary blade into said cutting position by pressing said second rotary blade onto said second fixed blade.

* * * * *